US010663129B1

(12) United States Patent
Zhong

(10) Patent No.: US 10,663,129 B1
(45) Date of Patent: May 26, 2020

(54) EMERGENCY LIGHTING FIXTURE

(71) Applicant: SHENZHEN ITSUWA LIGHT CO., LTD., Shenzhen, Guangdong Province (CN)

(72) Inventor: Ming Zhong, Shenzhen (CN)

(73) Assignee: SHENZHEN ITSUWA LIGHT CO., LTD., Shenzhen, Guangdong Province (CN)

( * ) Notice: Subject to any disclaimer, the term of this patent is extended or adjusted under 35 U.S.C. 154(b) by 0 days.

(21) Appl. No.: 16/236,523

(22) Filed: Dec. 30, 2018

(51) Int. Cl.

| | |
|---|---|
| ***F21S 9/02*** | (2006.01) |
| ***F21V 3/00*** | (2015.01) |
| ***F21V 23/02*** | (2006.01) |
| ***F21V 15/015*** | (2006.01) |
| ***F21V 23/04*** | (2006.01) |
| ***F21V 23/00*** | (2015.01) |
| ***F21Y 103/00*** | (2016.01) |

(52) U.S. Cl.
CPC ..... *F21S 9/022* (2013.01); *F21V 3/00* (2013.01); *F21V 15/015* (2013.01); *F21V 23/003* (2013.01); *F21V 23/02* (2013.01); *F21V 23/0471* (2013.01); *F21Y 2103/00* (2013.01)

(58) Field of Classification Search
CPC .. F21S 9/022; F21V 3/00; F21V 23/02; F21V 23/003; F21V 23/0471; F21V 15/015
See application file for complete search history.

(56) References Cited

U.S. PATENT DOCUMENTS

| | | | | |
|---|---|---|---|---|
| 8,186,847 | B2 * | 5/2012 | Hu | F21V 15/01 362/225 |
| 2012/0169234 | A1 * | 7/2012 | Shew | H02J 9/065 315/88 |
| 2017/0310157 | A1 * | 10/2017 | Cannon | F21K 9/27 |

* cited by examiner

*Primary Examiner* — Thomas M Sember
(74) *Attorney, Agent, or Firm* — Cheng-Ju Chiang

(57) ABSTRACT

An emergency lighting fixture includes strip mounting plate, interfaces in both two sides of the mounting plate for connecting an external power supply. A lamp cover is connected one side of mounting plate. Light strip is formed between the mounting plate and the lamp cover. One the other side, there is backup battery and control module which can provide the power supply from the interface to backup battery and light strip. The backup battery, the interface, and the light strip are electrically connected to the control module, which integrates backup battery and light strip into a whole. When power supply is not stable or power outage, Backup Battery inside the emergency lamp will provide backup power for the emergency lighting fixture to make the emergency lighting fixture continue lighting so that the emergency lighting function can be achieved.

10 Claims, 4 Drawing Sheets

EMERGENCY LIGHTING FIXTURE

TECHNICAL FIELD

The present invention relates to lighting field, in particular to an emergency lighting fixture.

BACKGROUND

Currently, the existing emergency lighting fixture is composed of emergency battery pack and light strip. This structure is big and the emergency lighting fixture can't be installed in a small space.

Moreover, as the battery pack and the lighting fixture are separated, they need to be rewired before using. The workload is large and it is not convenient for the customer to install.

SUMMARY

In order to overcome the shortcoming of the existing technology, the utility model aims to provide an emergency lighting fixture, the overall shape of the emergency lighting fixture is similar to the existing fluorescent tubes, tubular lamps, etc., the size is small, the emergency lighting fixture can be installed directly in the exiting lighting fixture without refit; When power supply is not stable or power outage, Backup Battery inside the emergency lamp will provide backup power for the lamp to make the lamp continue lighting so that the emergency lighting function can be achieved.

The purpose of the utility model is achieved by the following technical solutions:

An emergency lighting fixture comprises strip mounting plate, and on the both side of the mounting plate, there are interfaces which are connected to external power supply; And there is light strip between the mounting plate and the lamp cover, one the other side, there is backup battery and control module which can provide the power supply from the interface to backup battery and light strip; The backup battery, the interface, and the light strip is electrically connected to the control module.

Further, a baffle plate is set on the mounting plate at the side which is away from the lamp cover, the baffle plate and the mounting plate forms accommodating portion which is used to accommodate the backup battery and control module.

Further, the emergency lighting fixture according to claim 1, characterized in that: The first card slot is set in the side which is close to the lamp cover in the mounting plate. The second card slots is set in both sides of the first card slot to install the lamp cover in the mounting plate.

Further, the lamp cover including the lamp cover body and the first cover which is connected to one side of the lamp cover, the indicator module is set between the first cover and the mounting plate, the indicator module is electrically connected to the control module.

Further, the indicator module comprises test button, the test button is electrically connected to the control module. There are through-holes which are used to install the test button in the first cover.

Further, the lamp cover comprises the second cover which is in the other side of the lamp cover body, sensor module is set between the second cover and the mounting plate, the sensor module is electrically connected to the control module.

Further, the sensor module comprises the microwave sensor detector or PIR sensor detector in the control module.

Further, end caps are set on the both sides of the mounting plate, the interfaces are in the end caps, the sidewall of end caps comprise the first sidewall which is connected to the baffle plate and the second sidewall which is connected to the lamp cover, the length of the second sidewall is smaller than the length of the first sidewall.

Further, there is Insulating sleeve which is casing the control module.

Further, the interface is header and receptacle.

Comparing with the existing technology, the utility model has the beneficial effects that: through integrating backup battery and light strip into a whole, the emergency lighting fixture have interface on both side, the overall shape of the emergency lighting fixture is similar to the existing fluorescent tubes, tubular lamps, etc., the size is small, the emergency lighting fixture can be installed directly in the exiting lighting fixture without refit; When power supply is not stable or power outage, backup Battery inside the emergency lamp will provide backup power for the emergency lighting fixture to make the emergency lighting fixture continue lighting so that the emergency lighting function can be achieved.

FIGURE

110, mounting plate; 111, the first card slot; 112, the second card slot 113, Screw installation part; 121, Interface; 122, end cap; 123, sidewall; 1231, the first sidewall; 1232, the second sidewall; 130, lamp cover; 131, lamp cover body; 132, the first cover; 1321, through-holes; 133, the second cover; 140, light strip; 150, backup battery; 160, control module; 161, flex cable; 162, insulating sleeve; 170, baffle plate; 180, indicator module; 181, Indicator; 182, test button; 190, sensor module; 10, accommodating portion

DETAILED DESCRIPTION OF THE EMBODIMENTS

Below, embodiments of the present invention will be described in greater detail with reference to the drawings. It should be noted that the figures are illustrative rather than limiting. The figures are not drawn to scale, do not illustrate every aspect of the described embodiments, and do not limit the scope of the present disclosure. It should be noted that new embodiments may be formed by any combination between the embodiments or between the technical features describe below.

Embodiment 1

Figure 1:
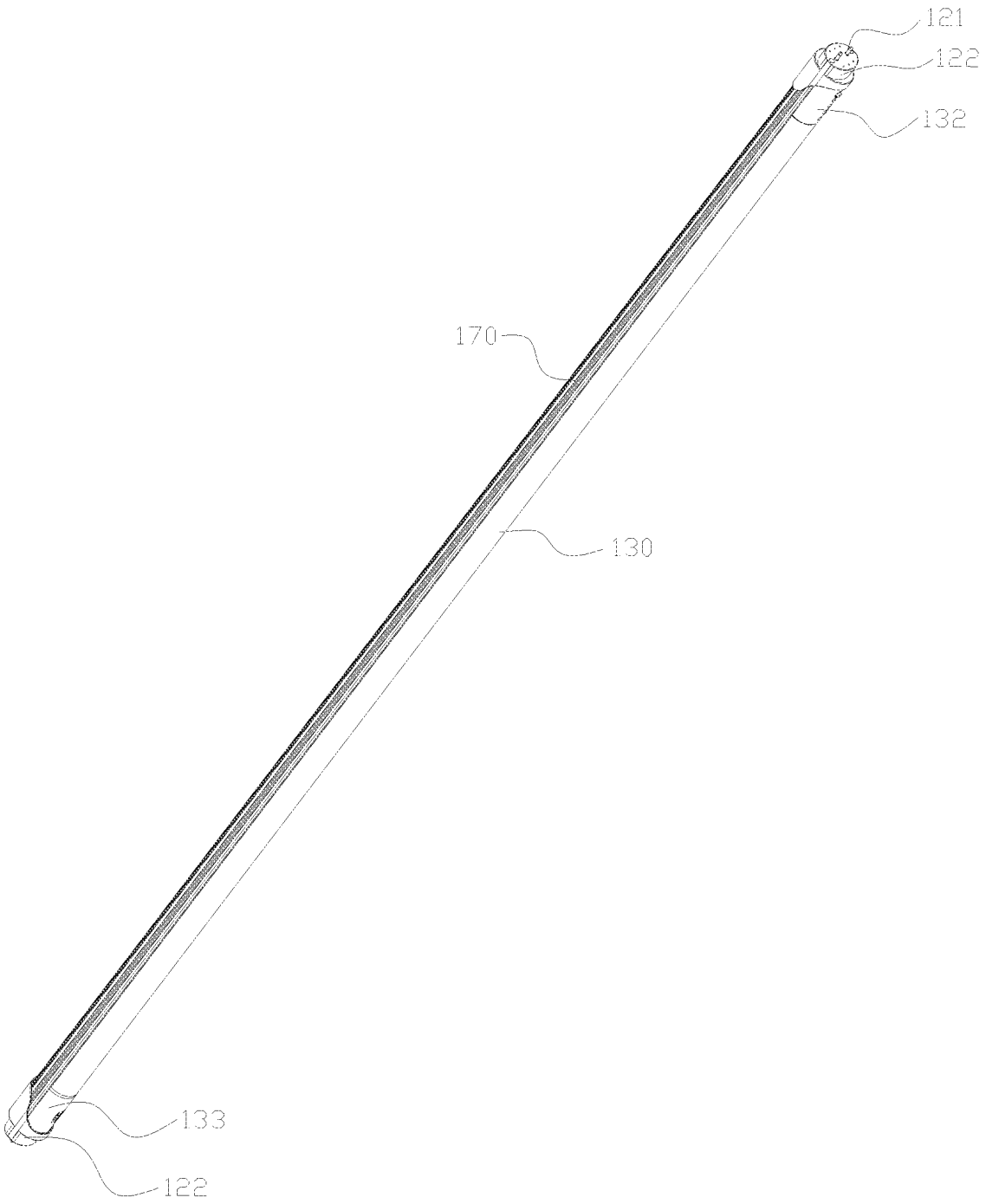
FIG. 1 is the schematic diagram of emergency lighting fixture in the utility model Embodiment 1.
Figure 2:
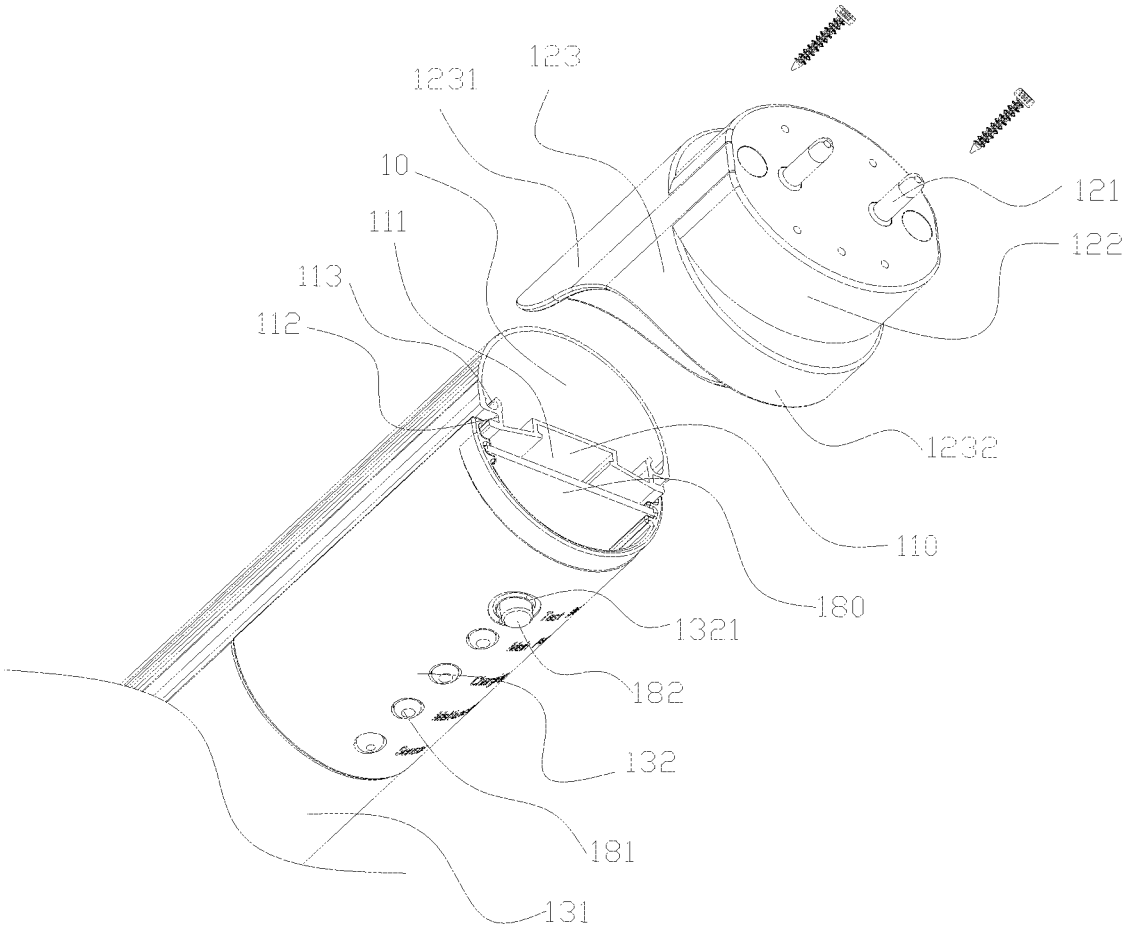
FIG. 2 is the schematic diagram of one side of the emergency lighting fixture In FIG. 1.
Figure 3:
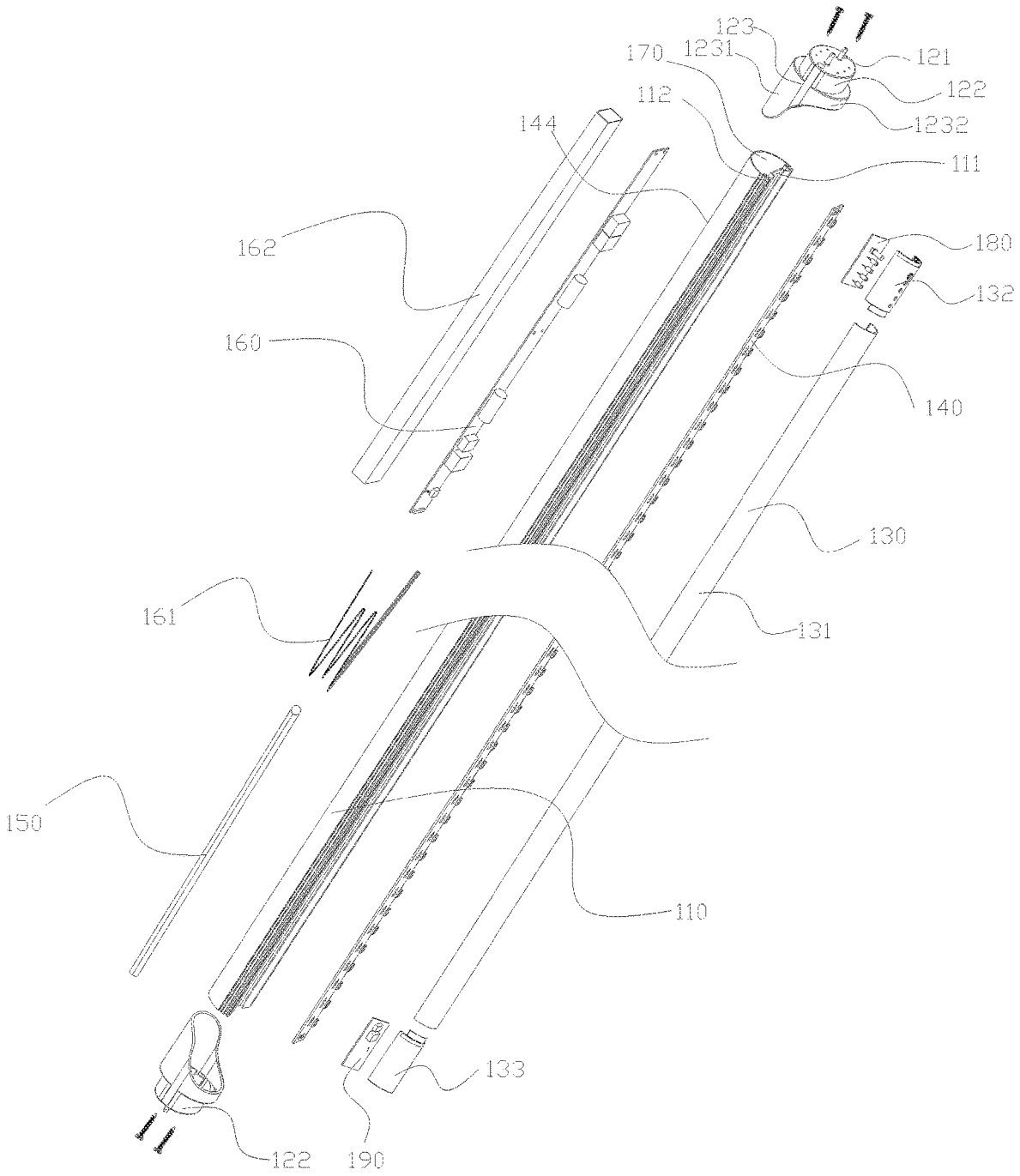
FIG. 3 is the decomposition diagram of Figure for the emergency lighting fixture.

As the emergency lighting fixture shown in the FIGS. 1-3, comprises strip mounting plate 110.

There are interfaces 121 in both sides of the strip mounting plate 110. On one side of strip mounting plate 110, there are lamp cover 130 connected to the mounting plate, and there is light strip 140 between the mounting plate 110 and lamp cover 130, one the other side, there are backup battery 150 and control module 160. The backup battery 150, the interface 121, and the light strip 140 are electrically connected to the control module 160, all of them can be electrically connected together through a flex cable 161. The interfaces 121 are used to be connected to the external power supply. The control module is used to supply the electric energy from the interface 121 to the backup battery 150 or light strip 140.

Backup battery 150 can be rechargeable battery, such as the lithium battery, also can be no-rechargeable battery, such as dry battery, button battery etc.

The emergency lighting fixture in the exemplary embodiments of the present invention:

The backup battery 150 and light strip 140 are integrated into a whole. The emergency lighting fixture have interface 121 on both sides. The overall shape of the emergency lighting fixture is similar to the existing fluorescent tubes, tubular lamps, etc, the size is small, the emergency lighting fixture can be installed directly in the exiting lighting fixture without refit. When power supply is not stable or power outage, Backup Battery inside the emergency lighting fixture will provide backup power for the emergency lighting fixture to make the emergency lighting fixture continue lighting so that the emergency lighting function can be achieved.

In a preferred embodiment, there is baffle plate 170 which is set on the mounting plate 110 at the side which is away from the lamp cover 170, the baffle plate 170 and mounting plate 110 forms accommodating portion 10 which is used to accommodate the backup battery 150 and control module 160, which prevent the Backup battery 150 and control module 160 from moving around, water leakage or Accumulated dust.

In a preferred embodiment, there is insulating sleeve 162 which is casing the control module 160, which can prevent the short circuit of control module 160, baffle plate 170 or mounting plate 110.

In a preferred embodiment, the first card slot 111 is set in the side which is close to the lamp cover 130 in the mounting plate 110 to install light strip 140, the second card slot 112 is set in both sides of the first card slot 111 to install the lamp cover 130 in the mounting plate 110.

The mounting plate 110 can adopt aluminium heat sink, light strip 140 is installed in aluminum heat sink to dissipate heat in time to prevent the build-up of high temperature.

As the further improvement of the present invention, the lamp cover 130 comprises the lamp cover 131 body and the second cover 133, the sensor module 190 is set between the second cover 133 and the mounting plate 110, and the sensor module 190 is electrically connected to the control module 160. The second cover 133 can be also connected on the second card slot 112 of the mounting plate 110.

In a preferred embodiment, an indicator module refers to a circuit board with an indicator 181, the circuit can be installed on the first cover, or mounting plate 110. The indicator 181 can indicate the working status of the emergency lighting fixture, according to the control module 160, such as external power supply, power supply for Backup Battery 150, low quantity of electricity of Backup battery etc.

In a preferred embodiment, the indicator module 180 comprises test button 182. The test button is electrically connected to the control module 160, the through-holes are set in a first cover 132 which are used to install test button 182.

If the test button 182 is pressed, that can make the control module 160 cut off the power supply from external power connected through the interface 121, so as to test if the emergency lighting can start up normally. Of course, the test button 182 can also implement other existing test functions, but will not be described again here.

As the further improvement of the utility model, the lamp cover 130 comprises the lamp cover 131 body and the second cover 133, the sensor module 190 is set between the second cover 133 and the mounting plate 110, and the sensor module 190 is electrically connected to the control module 160. The second cover 133 can be also connected on the second card slot 112 of the mounting plate 110.

The sensor module comprises the microwave sensor detector or PIR sensor detector in the control module (at least one), the microwave sensor detector or PIR sensor detector is electrically connected to the control module 160.

Through setting the sensor module 190, emergency lighting can be realized through sensor module 190 starts up automatically when people enter, which is convenient for the user.

Similarly, sensor module 190 can be installed on the second cover 133 or mounting plate 110.

In a preferred embodiment, end caps are set on the both sides of the mounting plate 110, the interfaces 121 are in the end caps 122, the sidewall 123 of the end caps 122 comprise the first sidewall 1231 which is connected to the baffle plate 170 and the second sidewall 1232 which is connected to the lamp cover 130, the length of the second sidewall 1232 is smaller than the length of the first sidewall 1231, then the indicator module 180 or sensor module 190 can be set on the first sidewall 1231 which is shorter, and can ensure the fixing of the interface 121, baffle plate 170 and lamp cover 130, meanwhile can saving space, can make the length of the emergency lighting fixture shorter.

The light strip can be led strip, fluorescent tube etc.

In this embodiment, the baffle plate 170 and mounting plate 110 is integrated structure, the section of the baffle plate 170 is semi-circular. Screw installing position 113 is set in the connection between the baffle plate 170 and mounting plate 110, end caps 122 are fixed on the screw installing position 113 and mounting plate 113 through screw, further prevent the end caps from loosing, the interface 121 is header which is used to be connected to external power supply, the other side of the header is connected to the control module 160.

Embodiment 2

Figure 4:
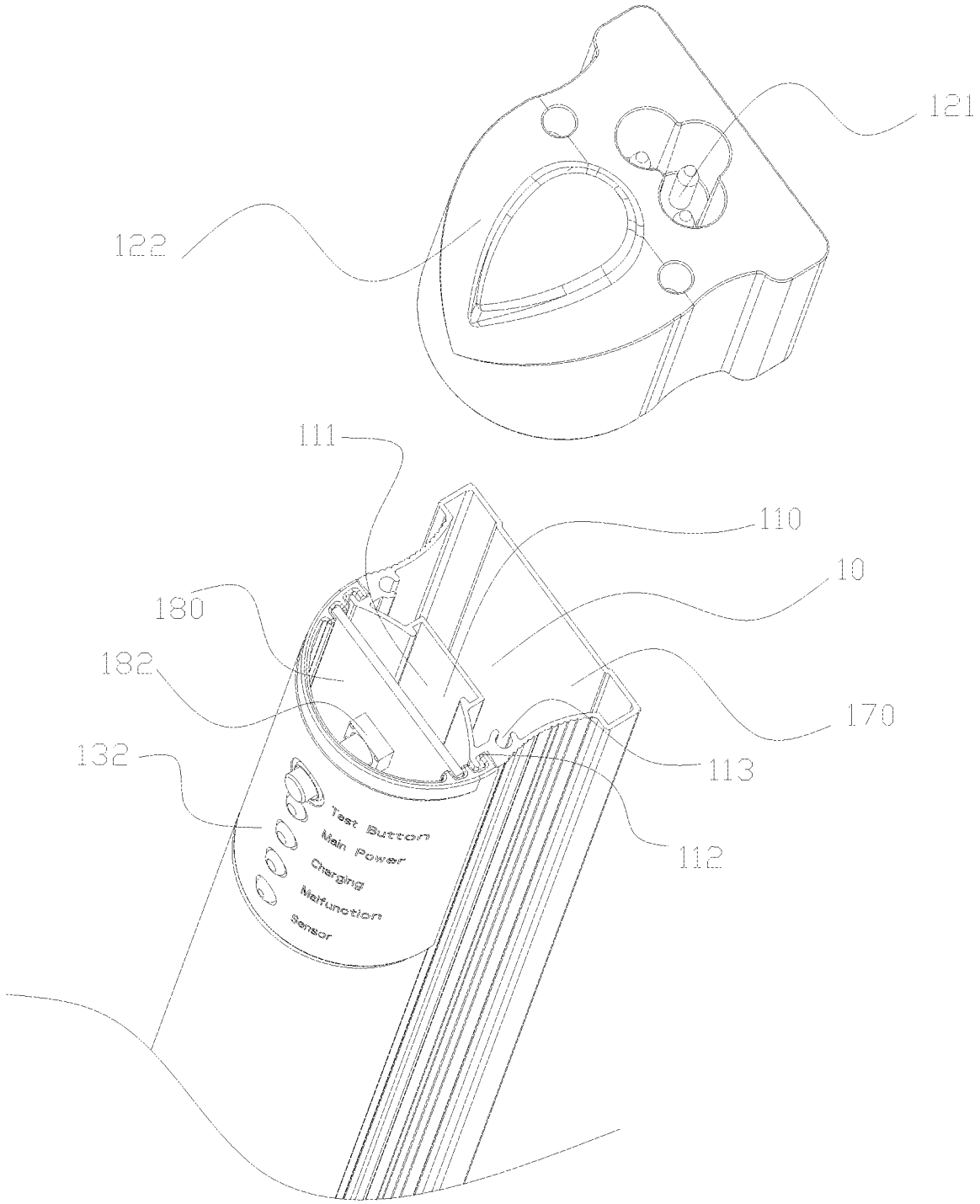
FIG. 4 is the schematic diagram of one side of the emergency lighting fixture in the utility model Embodiment 2.

What is shown in the FIG. 4 is the emergency lighting fixture in the Exemplary embodiment of the utility model, the difference the embodiment 2 and embodiment 1 is: the section of the baffle plate 170 is broken-line shape, the interface 121 is the receptacle which is used to be connected to external power supply, the other side of the receptacle is connected to the control module 160, can be installed in different lamp fixtures.

The above embodiments are merely preferred embodiments of the utility model, and the scope of protection of the utility model is not limited thereto, and any insubstantial changes and substitutions made by the technical staff in the field based on the utility model belongs to the claimed scope of the protection of the utility model.

Therefore, the technical solutions of embodiments of the present invention have been clearly and completely described above. Apparently, the described embodiments are merely part of, rather than all of, the embodiments of the present invention. A person skilled in the art may make various combinations of technical features in the various embodiments to meet practical needs. Based on the described embodiments of the present invention, any other embodiment obtained by a person skilled in the art without paying creative efforts shall also fall within the scope of the present invention.

What is claimed is:

1. An emergency lighting fixture, comprising a strip mounting plate, interfaces being formed on both sides of the mounting plate for being connected to an external power supply, a lamp cover being connected to one side of the mounting plate, a light strip being arranged between the mounting plate and the lamp cover, a backup battery and a control module being arranged on another side of the mounting plate, the control module being capable of providing power supply from the interface to the backup battery and the light strip, a first card slot which is used to install the light strip is set in one side which is close to the lamp cover on the mounting plate; a baffle plate is set by the mounting plate on one side which is away from the lamp cover, the baffle plate and the mounting plate is integrated structure; the backup battery, the interface, and the light strip being electrically connected to the control module.

2. The emergency lighting fixture according to claim 1, wherein a section of the baffle plate is semi-circular or broken-line shape, and the baffle plate and mounting plate form accommodating portion which is used to accommodate the backup battery and control module.

3. The emergency lighting fixture according to claim 2, wherein there are end caps on the both sides of the mounting plate, the interfaces are in the end caps, the sidewall of end caps comprise a first sidewall which is connected to the baffle plate and a second sidewall which is connected to the lamp cover, a length of the second sidewall is smaller than the length of the first sidewall.

4. The emergency lighting fixture according to claim 1, wherein a second card slot is set in both sides of the first card slot to install the lamp cover on the mounting plate.

5. The emergency lighting fixture according to claim 1, wherein the lamp cover including the lamp cover itself and a first cover which is connected to one side of the lamp cover, an indicator module is set between the first cover and the mounting plate, the indicator module is electrically connected to the control module.

6. The emergency lighting fixture according to claim 5, wherein the indicator module comprises a test button, the test button is electrically connected to the control module, and through-holes are formed in the first cover for installing the test button in the first cover.

7. The emergency lighting fixture according to claim 5, wherein the lamp cover comprises the second cover which is in another side of the lamp cover, a sensor module is set between the second cover and the mounting plate, the sensor module is electrically connected to the control module.

8. The emergency lighting fixture according to claim 7, wherein the sensor module comprises a microwave sensor detector or PIR sensor detector in the control module.

9. The emergency lighting fixture according to claim 1, further comprising an insulating sleeve which is casing the control module.

10. The emergency lighting fixture according to claim 1, wherein the interfaces are header and receptacle.

* * * * *